US006477966B1

(12) United States Patent
Petryna

(10) Patent No.: US 6,477,966 B1
(45) Date of Patent: Nov. 12, 2002

(54) MODULAR ROTATABLE TRAY SYSTEM

(76) Inventor: Thomas M. Petryna, 615 Guy Street, Cornwall, ON (CA), K6H 4V9

( * ) Notice: Subject to any disclaimer, the term of this patent is extended or adjusted under 35 U.S.C. 154(b) by 0 days.

(21) Appl. No.: 09/542,925

(22) Filed: Apr. 4, 2000

(51) Int. Cl.[7] ..... A47B 85/00
(52) U.S. Cl. ..... 108/11; 108/151; 211/107
(58) Field of Search ..... 108/151, 152, 108/44, 19, 150, 128, 50.12, 11; 211/163, 107, 144, 133.4

(56) References Cited

U.S. PATENT DOCUMENTS 2,970,701 A * 2/1961 Fetter ..... 108/151
3,295,473 A * 1/1967 Wentworth ..... 108/44
5,335,803 A 8/1994 O'Brien et al.
5,848,712 A 12/1998 Weir

* cited by examiner

*Primary Examiner*—Lanna Mai
*Assistant Examiner*—Jerry A. Anderson
(74) *Attorney, Agent, or Firm*—Kent Daniels; Ogilvy Renault

(57) ABSTRACT

A modular rotatable food tray supported by a vertical support member features tray segments that are easily removable and free standing. Each tray segment has a depending clip that is received in a hub of a bearing for rotatably supporting the tray. The individual tray segments may be removed for filling and cleaning, and segments of different configuration can be used for different purposes. The trays can also be removed for serving away from the support member.

17 Claims, 10 Drawing Sheets

MODULAR ROTATABLE TRAY SYSTEM

CROSS-REFERENCE TO RELATED APPLICATIONS

This is the first application filed for the present invention.

MICROFICHE APPENDIX

Not Applicable.

TECHNICAL FIELD

The present invention relates to rotatable food service trays, and in particular to a modular rotatable food tray supported by a vertical pole, such as an umbrella pole disposed in the middle of an outdoor patio table.

BACKGROUND OF THE INVENTION

The umbrella has become commonplace in the use of outdoor table furniture, providing those who are seated at the table a degree of protection from sunlight, precipitation, or falling debris. Placement of the umbrella at the center of a table, the table accommodating the umbrella pole by use of a centrally disposed opening, provides an encompassing shelter over a perimeter of the table.

Similar to indoor tables, the umbrella table has a variety of uses, including that of a sitting location for the consumption of food. However, a centrally located umbrella pole presents an obstacle that persons at the table must pass food or dishes around. The umbrella pole not only creates an obstacle but it also occupies critical space in the middle of the table. Consequently, trays of various configuration have been invented to utilize the umbrella pole in order to minimize its distraction from the table space.

U.S. Pat. No. 5,335,803 (O'Brien et al) teaches a rotatable food tray for use in combination with an outdoor patio table having a centrally located umbrella. A bearing assembly is designed to surround the umbrella pole and rotatably support a tray. The bearing assembly can either rest on the table, or alternatively may be supported at a desired distance above the table by a support element secured to the umbrella pole. The tray is divided into a pair of semi-circular tray sections, which are designed to clip together to form a continuous tray surface which surrounds the umbrella pole.

U.S. Pat. No. 5,848,712 (Weir) teaches another rotatable tray, in which a unitary tray is rotatably supported a predetermined distance above a table surface by a support element fixedly attached to the tray and having an internal diameter slightly larger than an outer diameter of the umbrella pole.

The rotatable trays described in both of the above patents suffer a disadvantage that the tray must be installed about the umbrella pole before it can be used. However, food products are commonly prepared at a location remote from a garden table (e.g. in a kitchen or at a barbecue) and then carried to the garden table for serving. The trays of O'Brien et al and Weir cannot conveniently be used for conveying food products from the food preparation area to the garden table for serving, so that a second tray may frequently be required for this purpose. The tray of O'Brien et al suffers a further disadvantage in that it merely rests by gravity on the bearing assembly. With this arrangement, the tray of O'Brien et al is vulnerable to tipping in the event that the tray is unevenly loaded.

Accordingly, there remains a need for a rotatable tray system which enhances the convenience and enjoyment of outdoor patio furniture.

Outdoor decks and patios are highly popular for outdoor entertainment and social functions. Frequently, the use of outdoor patio furniture (such as tables with a centrally mounted umbrella) are conveniently used to enhance the value of the deck for this purpose. However, for large social gatherings, it may be undesirable to devote a large deck area to an umbrella table and surrounding chairs. In such cases, a rotatable tray mounted atop a supporting pole independently of an umbrella table would be highly desirable as a means of serving hors d'oeuvres or the like without occupying a large deck area.

SUMMARY OF THE INVENTION

An object of the present invention is to provide a rotatable tray system in which tray segments forming a modular tray are independently mountable on a hub disposed about a substantially vertical supporting pole.

An aspect of the present invention provides a rotatable tray system comprising: a hub assembly rotatably mountable on a substantially vertical support member; and a modular tray comprising a plurality of tray segments independently mountable on the hub, the plurality of tray segments being adapted to cooperatively define a substantially contiguous tray surface.

The substantially vertical support member is preferably a pole, such as, for example, an umbrella pole. The umbrella pole may be mounted in an umbrella table suitably designed for that purpose, or may be suitably supported in an umbrella stand independently of any other garden furniture. Alternatively, the substantially vertical support member can be a free-standing pole secured to a support assembly and arranged to support the rotatable tray system at a desired height above a deck surface independently of any other patio furniture such as tables or the like.

In an embodiment of the invention, the hub assembly comprises: an inner bearing member capable of being fixedly secured to the substantially vertical support member; and an outer bearing member having a substantially cylindrical bore capable of slidably receiving the inner bearing member such that the outer bearing member is freely rotatable about the inner bearing member, and pivoting of the outer bearing member with respect to the inner bearing member is inhibited.

The inner bearing member may include a pair of opposed semi-cylindrical bearing portions defining an axial channel for receiving the support member. In this case, the opposed semi-cylindrical bearing portions are preferably capable of clamping engagement with the substantially vertical support member. Further, the inner bearing preferably includes at least one fastener capable of securing the semi-cylindrical bearing portions to one another and to the support member by clamping the support member between the semi-cylindrical bearing portions.

Preferably, the inner bearing comprises: an upper bearing surface capable of slidable load-bearing engagement with an end wall of the cylindrical bore of the outer bearing member; and at least one perimeter wall for slidably engaging a side wall of the cylindrical bore of the outer bearing member to prevent pivoting between the inner and outer bearing members. The inner bearing may include at least one flange portion, a respective outer edge of each flange portion defining the at least one perimeter wall.

Preferably, the bore of the outer bearing member comprises: a substantially cylindrical inner wall and an end wall. The cylindrical inner wall is preferably capable of sliding engagement with a perimeter wall of the inner bearing member to substantially prevent pivoting of the outer bearing member relative to the inner bearing member. The end wall is preferably capable of slidable load-bearing engagement with an upper bearing surface of the inner bearing member.

In an embodiment of the invention, the outer bearing member further comprises a receptacle portion capable of receiving a respective clip portion of each tray segment to thereby removably secure the respective tray segment to the outer bearing member. The receptacle portion may comprise an annular groove.

In an embodiment of the invention, each tray segment comprises: a top surface defining a portion of the substantially contiguous tray surface; and a clip portion depending from the top surface for securing the tray segment to the hub assembly.

Each tray segment may be independently mountable to extend radially outwardly from the hub assembly.

The respective top surface of each tray segment may define a substantially equal portion of the tray surface. The clip portion may comprise a semi-cylindrical wall disposed proximal an inner edge of the respective top surface of each tray segment.

An advantage of the present invention is that the tray segments can be individually attached to the hub assembly for rotation about the supporting member (pole). The inner and outer bearing members of the hub assembly cooperate to prevent the modular tray from tipping, even when it is partially complete (i.e. tray segments are missing) or when it is loaded in an unbalanced manner.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

Figure 1:
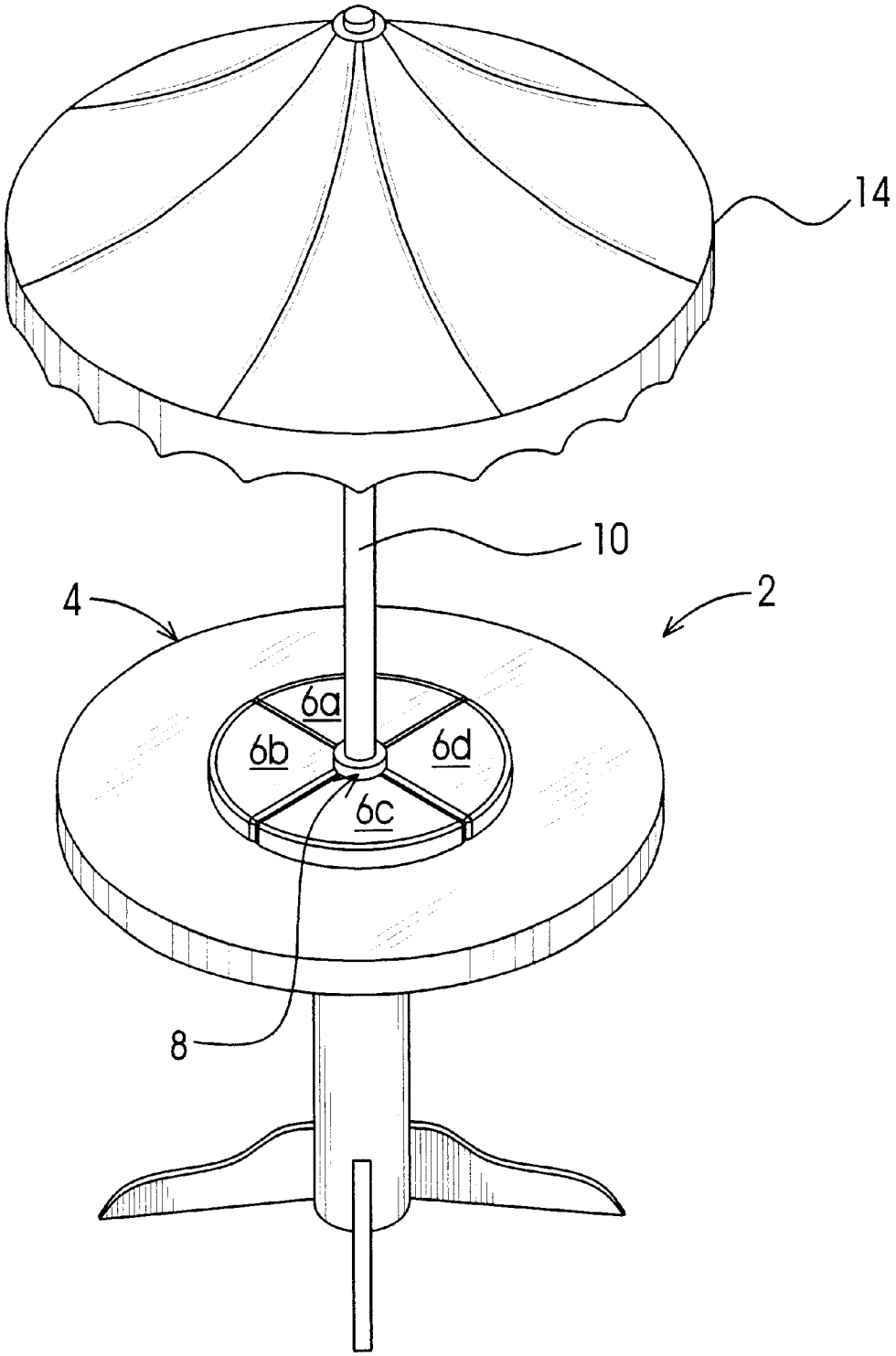
FIG. 1 is a perspective view showing a rotatable tray system in accordance with an embodiment of the present invention mounted for use about an umbrella pole.
Figure 2:
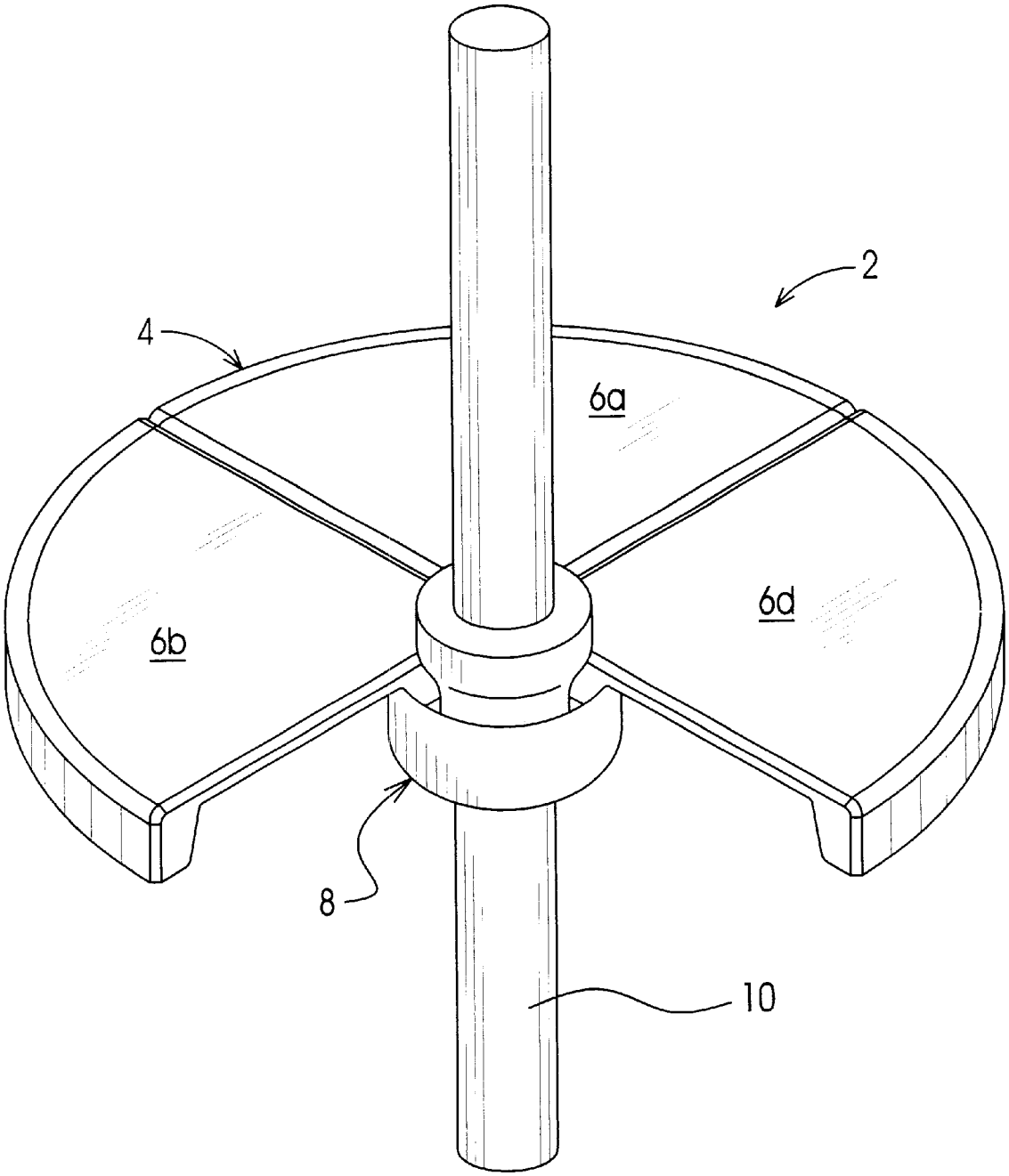
FIG. 2 is a perspective view showing the embodiment shown in FIG. 1 with one of the tray segments removed.

The present invention provides a rotatable tray system 2 in which a modular tray 4 includes a plurality of tray segments 6 and a central hub assembly 8. As shown in FIGS. 1 and 2, the hub assembly 8 is designed to be mounted about a substantially vertical support 10 such as, for example, an umbrella pole. Each of the tray segments 6 is designed to be individually mounted to the hub 8 to define a modular tray 4 which is rotatable about the support member 10. Thus a modular tray 4 can be formed which completely surrounds the support member 10 (as shown in FIG. 1). Alternatively, a modular tray 4 only partially surrounding the support member 10, as shown in FIG. 2, may be used.

In preferred embodiments of the invention, the outer (e.g. plan-view) dimensions of all of the tray segments 6 are substantially identical, so that tray segments 6 are fully interchangeable on the hub assembly 8. In the illustrated embodiment, four tray segments 6 are used to define a complete modular tray 4 surrounding the support member 10. Furthermore, each tray segment 6 is shaped as a sector of a circle, so that the complete modular tray 4 is substantially circular in plan view. It will be appreciated however that more or fewer tray segments 6 may be utilized in the construction of a modular tray 4. Similarly, the shape of the tray segments 6 may differ from that shown in the illustrated embodiments, so as to provide a desired shape of a complete modular tray 4. The tray segments 6 may be used alone or in combination to provide a complete or partial modular tray surface as desired. Preferably, the tray segments 6 are sized to facilitate easy cleaning in, for example, a standard kitchen sink, or dish-washer machine.

Figure 3A:
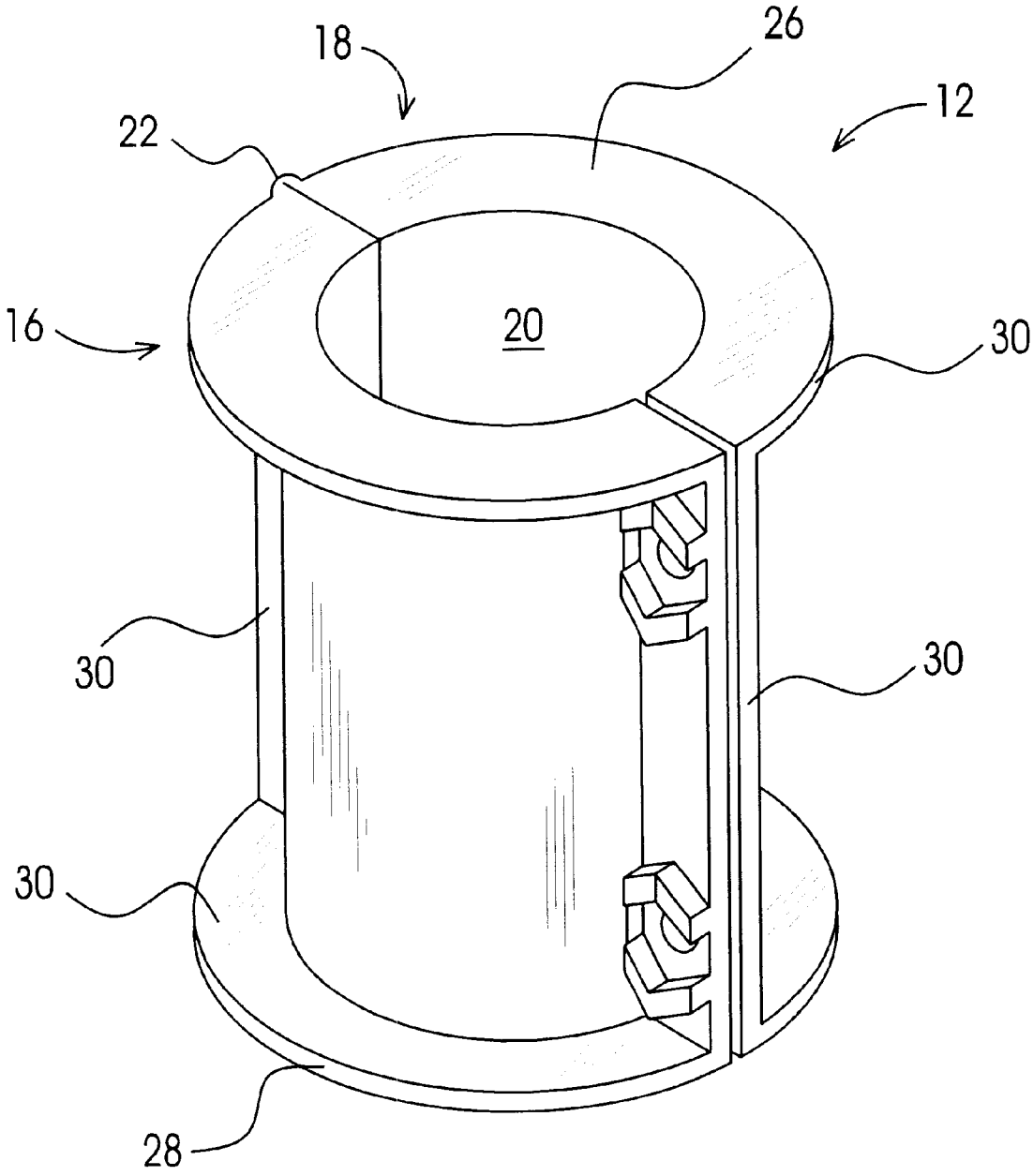
FIG. 3*a* shows an inner bearing member of the hub assembly of the embodiment shown in FIG. 1.
Figure 3B:
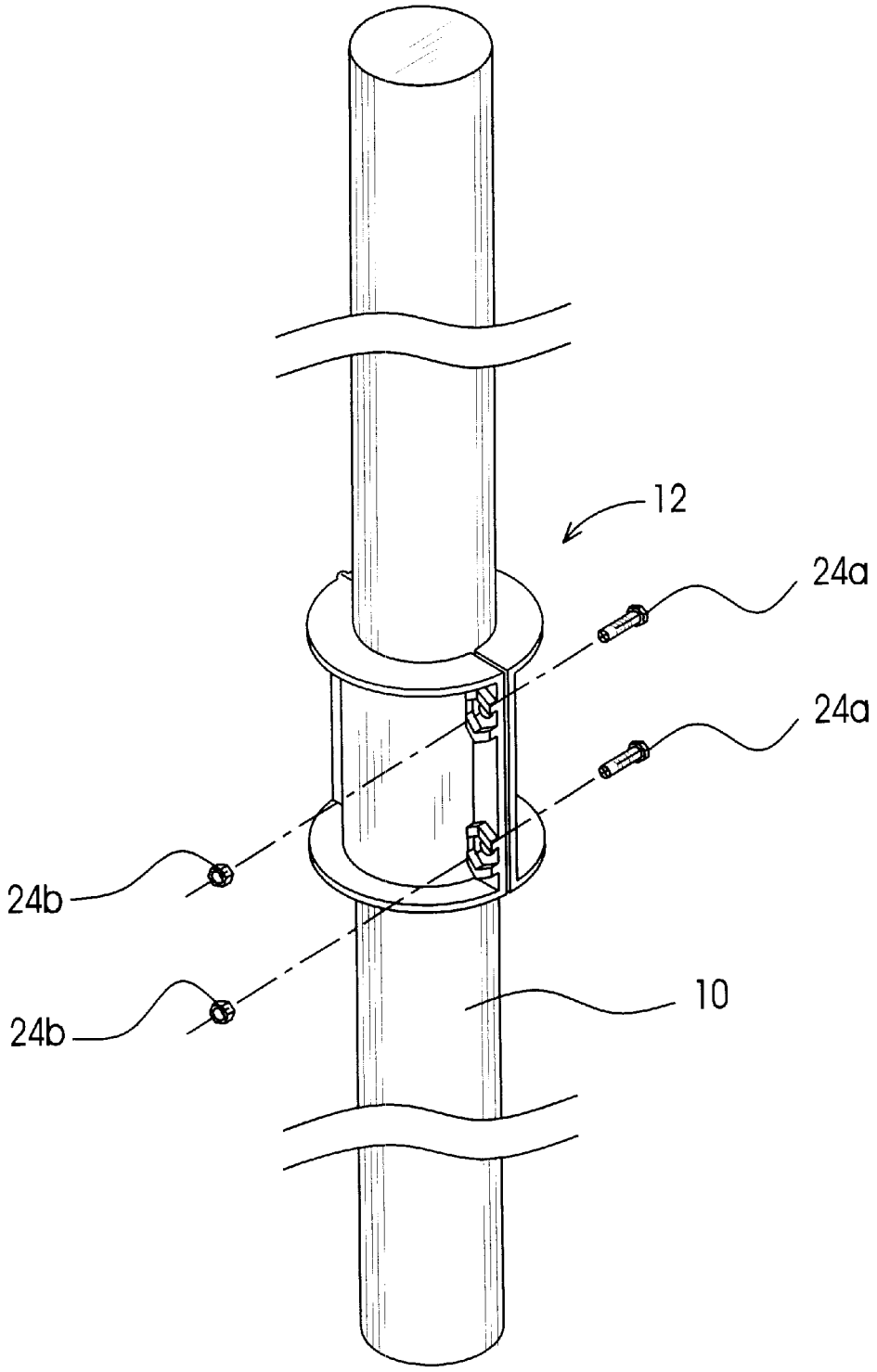
FIG. 3*b* the inner bearing shown in FIG. 3*a* mounted about an umbrella pole.

Referring now to FIGS. 3 and 4, the hub assembly 8 includes an inner bearing member 12 which is designed to be fixedly mounted about the vertical support member 10, and an outer bearing member 14 which is designed to be rotatably mounted about the vertical support member 10 while being supported and stabilized by the inner bearing member 12. As shown in FIG. 3*a* the inner bearing member 12 may conveniently be formed by a pair of bearing elements 16,18 which cooperate to define an interior channel 20 sized to receive the vertical support 10. The bearing elements 16,18 may be independently formed (and therefore separable), or may be joined by a plastic hinge 22 along a common longitudinal edge as shown in FIG. 3*a*. In either case, the bearing elements 16,18 are designed to cooperate to receive the vertical support member 10 and to be secured to each other by at least one fastener 24 (see FIG. 3*b*) which secures the inner bearing member 12 to the vertical support member 10.

As shown in FIGS. 3*a* and 3*b*, the inner bearing member 12 includes an upper bearing surface 26 which receives and supports axial loads due, for example, to the weight of the modular tray 4 and food products placed on the tray. In addition, at least one peripheral surface 28 is provided distal from the upper bearing surface 26 so as to stabilize the modular tray 4 against tipping in an event that it is unevenly loaded. In the embodiment shown in FIGS. 3*a* and 3*b*, the upper bearing surface 26 and the peripheral surface 28 are provided by face and perimeter edge surfaces of respective flanges 30 extending outwardly from the central channel 20 of the inner bearing member 12.

Figure 4A:
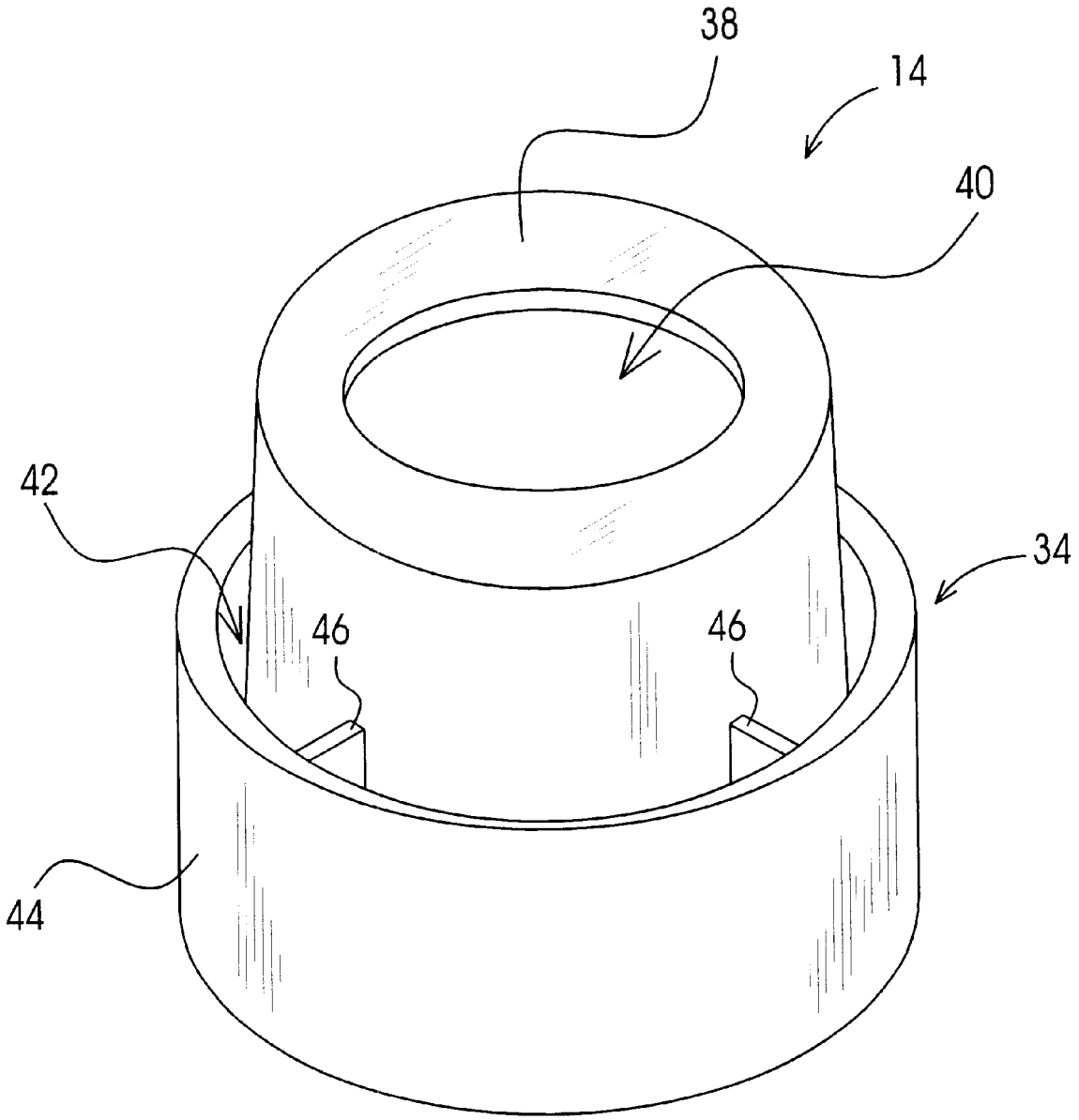
FIGS. 4*a* and 4*b* are perspective views of an outer bearing member of the hub assembly of the embodiment shown in FIG. 1.
Figure 4B:
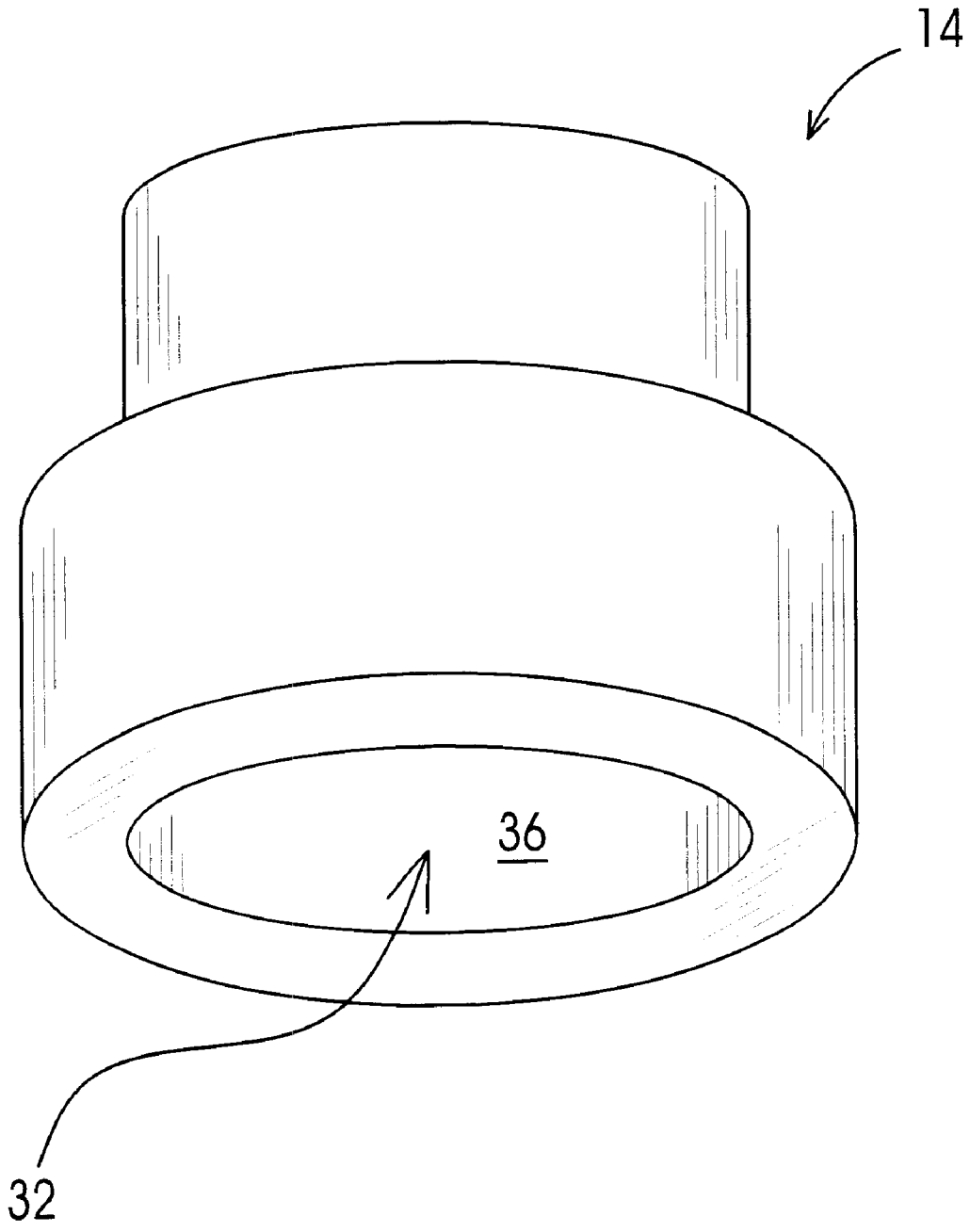

Referring now to FIGS. 4*a* and 4*b*, the outer bearing member 14 is conveniently provided as a generally hat-shaped component having a central bore 32 sized to receive the inner bearing member 12 and a receptacle portion 34 designed to facilitate the mounting of tray segments 6 around the exterior of the hub assembly 8. The central bore 32 generally includes a cylindrical inner wall 36 and an end wall 38 that at least partially occludes one end of the bore. The cylindrical inner wall 36 preferably has an inner diameter slightly larger than the outer diameter of the peripheral edges 28 of the inner bearing member 12, so that there is sufficient clearance between the inner bearing member 12 and the interior wall 36 of the bore 32 to permit the outer bearing member 14 to rotate freely on the inner bearing member 12. On the other hand, the clearance between the inner bearing member 12 and the interior wall 36 of the bore 32 must be sufficiently small so that the outer bearing member 14 is effectively stabilized against tipping with respect to the inner bearing member 12 (by contact between peripheral edges 28 of the inner bearing member 12 and the interior wall 36 of the bore 32). The end wall 38 of the bore is designed for sliding contact with the upper bearing surface 26 of the inner bearing member 12, so that axial loads (e.g. due to the weight of food items placed on the modular tray 4) can be transmitted from the outer bearing member 14 to the inner bearing member 12 and thus to the vertical support 10. An opening 40 within the end wall 38 of the bore 32 can be provided to permit passage of the vertical support 10.

As shown in FIG. 4*a*, the receptacle 34 is conveniently provided as an annular groove 42 or slot defined by a circumferential outer wall 44 extending around the exterior of the outer bearing member 14. Bracing walls 46 extending across the annular groove 42 can be used to increase rigidity of the exterior wall 44 and so improve the stability with which tray segments 6 may be affixed to the outer bearing member 14.

Figure 5:
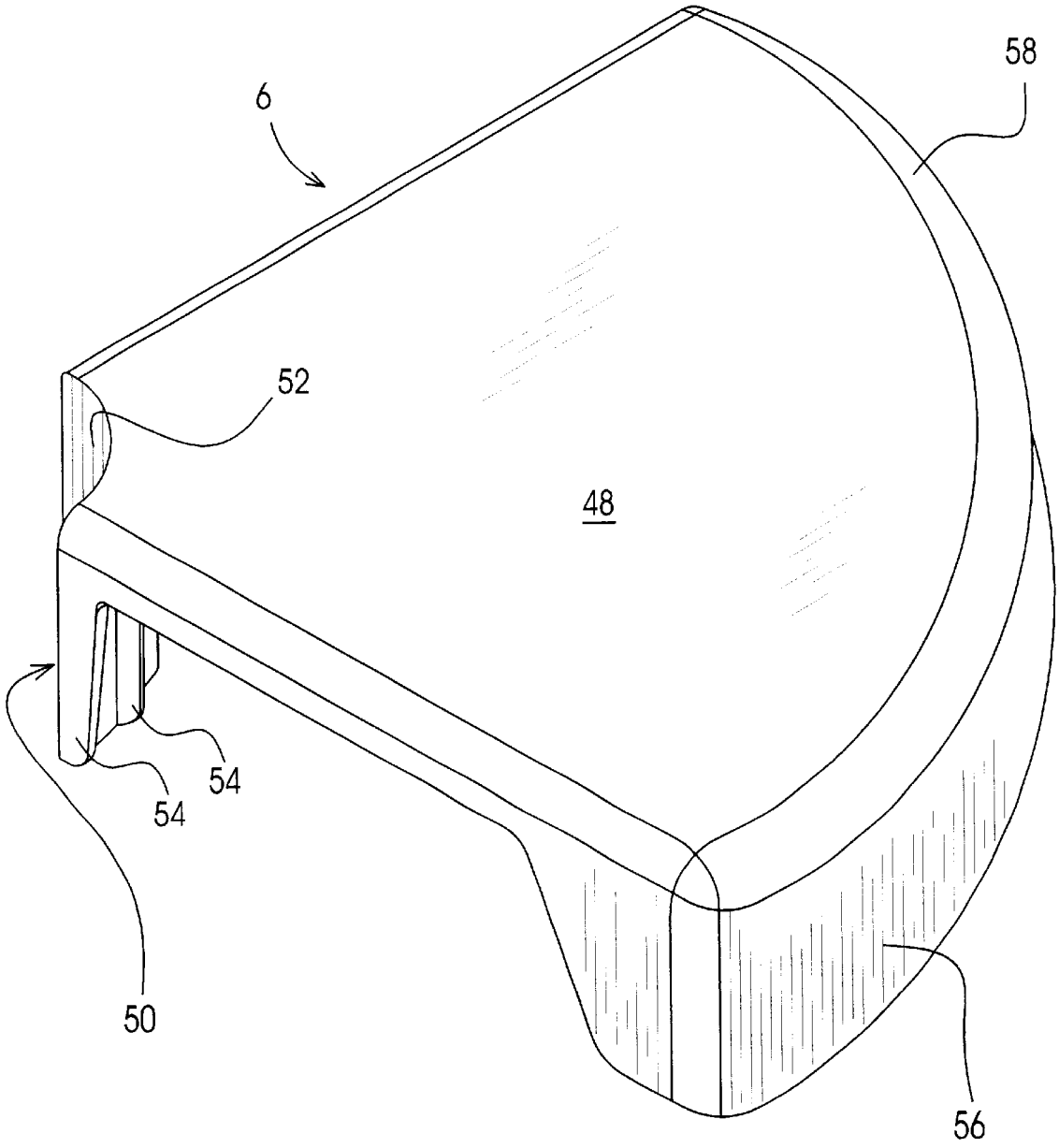
FIG. 5 is an enlarged perspective view showing a tray segment of the modular tray shown in FIG. 1.

As shown in FIG. 5, each tray segment 6 generally comprises a top surface 48 and a clip portion 50 that extends from the top surface 48 for securing the tray segment 6 to the hub assembly 8. The clip portion 50 is preferably a cylindrical section-shaped wall 52 which is sized to fit within the receptacle portion 34 of the outer bearing member 14 to thereby removably secure the tray segment 6 to the hub assembly 8. The cylindrical section-shaped wall 52 of the clip portion 50 may be reinforced with ribs 54 that extend (e.g. radially) under the top surface 48 to improve rigidity of the joint between the clip portion 50 and the top surface 48 to thereby stabilize the tray segment 6 when it is secured to the hub assembly 8. An optional perimeter wall 56 that depends from an outer edge 58 of the top surface 48 further rigidifies the tray segment 6, and thereby stabilizes the top surface 48. Preferably, the height of the perimeter wall 56 is selected to match that of the clip portion 50, so that the top surface 48 is supported in a level condition when the tray segment 6 is placed on a table or a countertop. This permits food items to be conveniently placed on the top surface 48 of the tray segment 6 proximal a food preparation area. The tray segment 6 can then be used to convey the prepared food items to a food serving area (e.g. a patio table) where the tray segment 6 is attached to the hub assembly 8 by inserting the clip portion 50 into the receptacle 34.

Figure 6D:
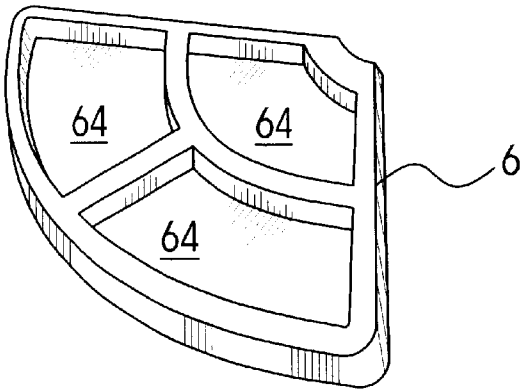
FIGS. 6*a* through 6*h* show respective alternative embodiments of a tray segment for the modular tray shown in FIG. 1.
Figure 6C:
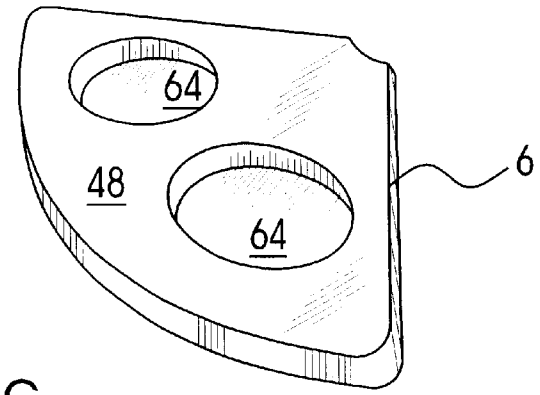
Figure 6A:
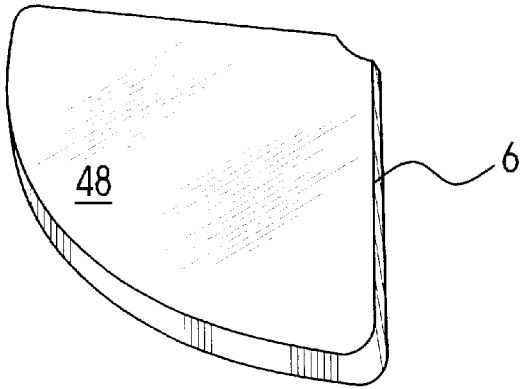
Figure 6B:
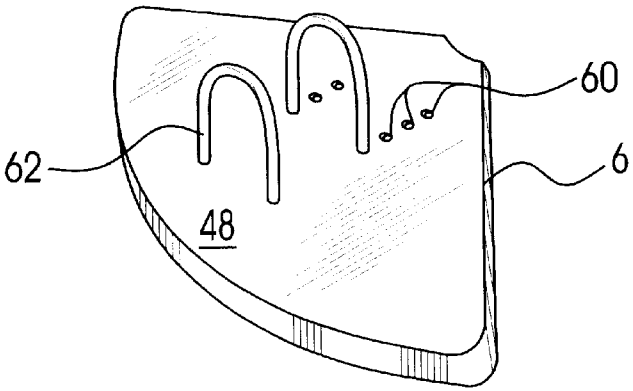
Figure 6F:
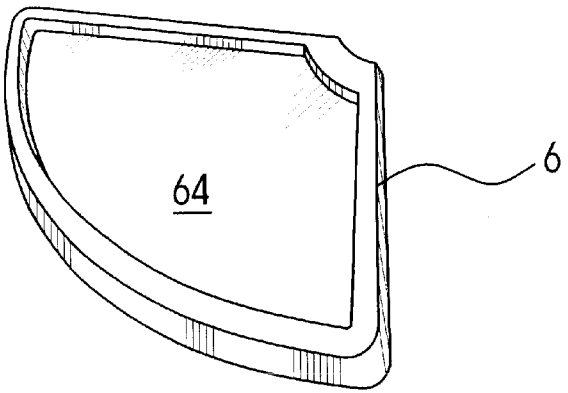
Figure 6H:
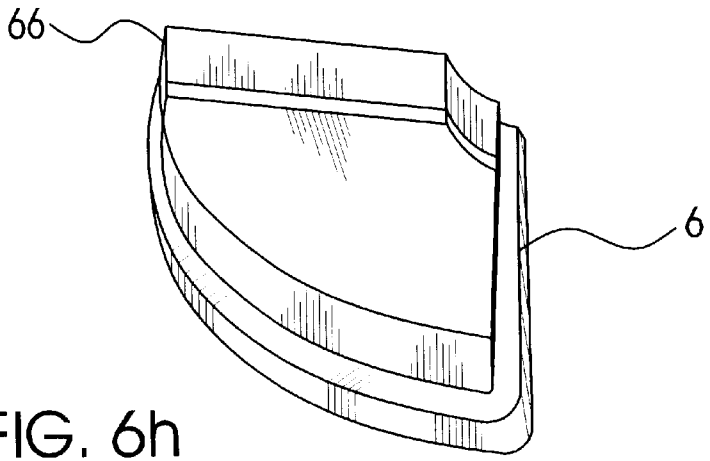
Figure 6E:
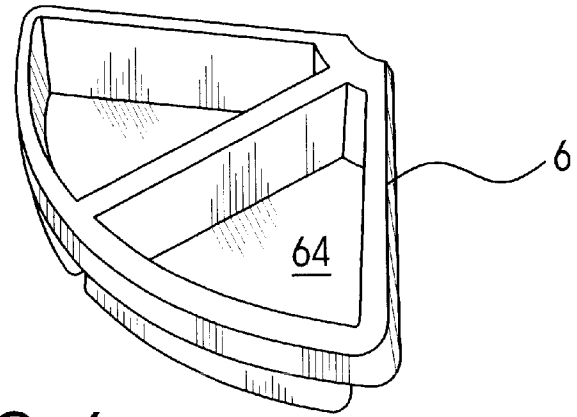
Figure 6G:
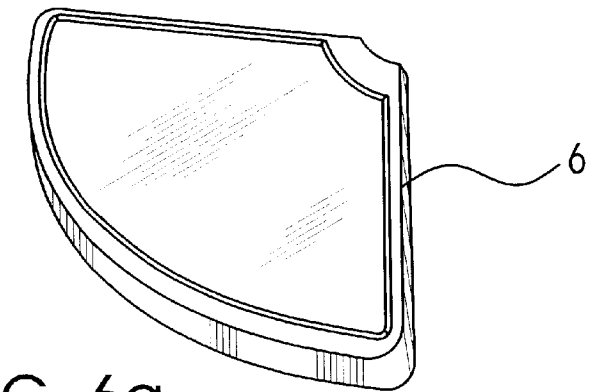

As shown in FIGS. 6*a* through 6*h*, various designs may be incorporated into the top surface 48 of the tray segment 6 as desired. FIG. 6*a* shows a basic tray segment 6 having a flat top surface 48 (as is also shown in FIGS. 1, 2 and 5). In the embodiment shown in FIG. 6*b*, holes 60 are provided in the top surface 48 to receive upstanding U-shaped supports 62 that define an adjustable napkin holder. In the embodiments of FIGS. 6*c* through 6*g*, compartments 64 of varying shape and size provide a user with a wide range of food service options. As shown in FIG. 6*h*, a lid or cover 66 (which may be transparent) can be provided for use in conjunction with any of the tray segment designs shown in FIGS. 6*a* through 6*g*, in order to shield food products from, for example, insects.

Figure 7:
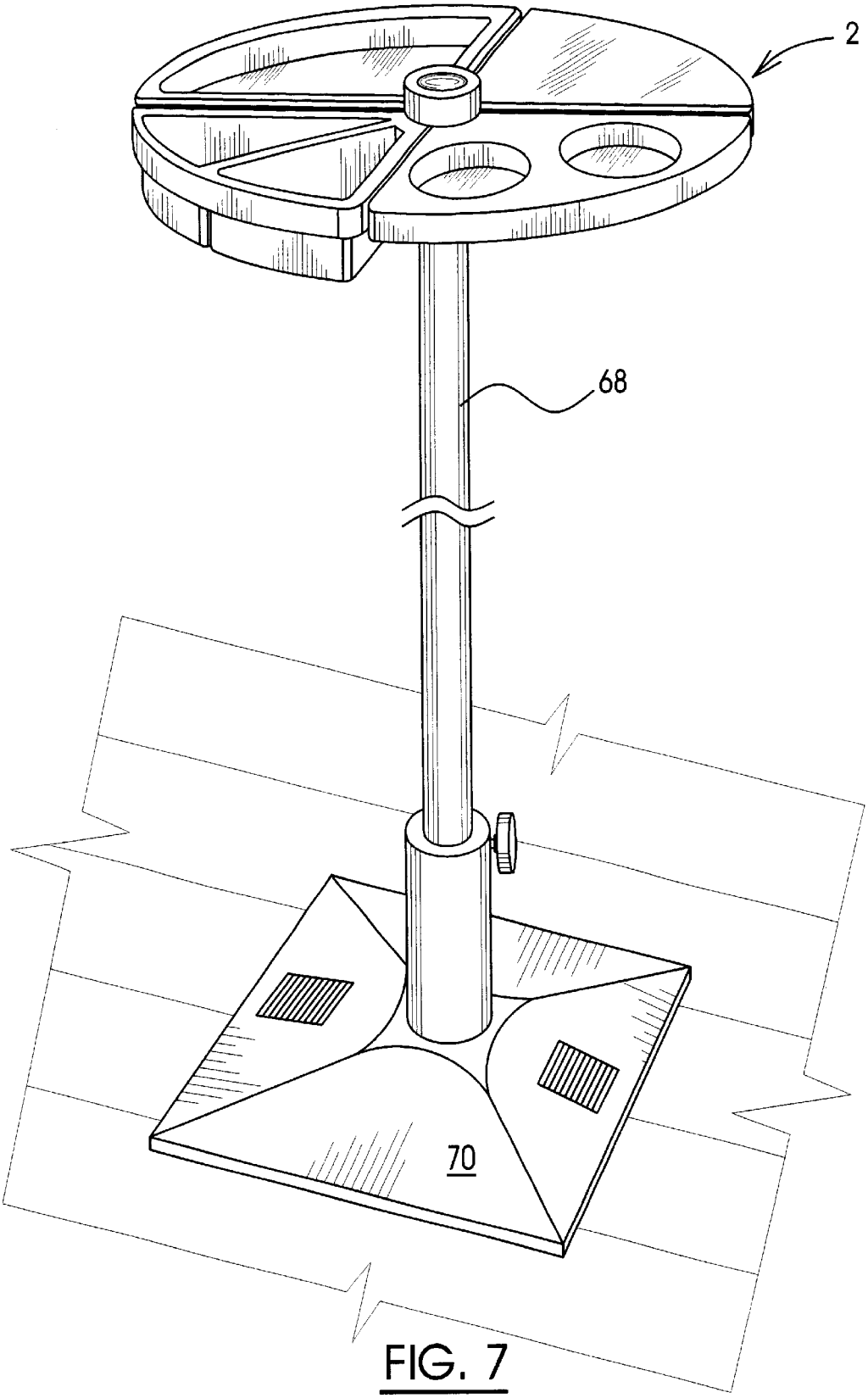
FIG. 7 is a perspective view showing a rotatable tray system in accordance with the embodiment shown in FIG. 1, mounted for use about a free-standing pole.

As shown in FIG. 7, the rotatable tray system 2 of the present invention may be used independently of an umbrella mounted in an umbrella table. In the example shown in FIG. 6, the rotatable tray system 2 is mounted about a free-standing pole 68 which is securely held in a base assembly 70 described in applicant's U.S. Pat. No. 5,961,091.

Thus it will be seen that the present invention provides enhanced convenience of enabling food items to be easily carried from a food preparation area to a patio table, and then providing a modular rotatable tray affixed to the patio table to facilitate the convenience and enjoyment of the patio table as an eating area.

The embodiment(s) of the invention described above is (are) intended to be exemplary only. The scope of the invention is therefore intended to be limited solely by the scope of the appended claims.

I claim:

1. A modular rotatable tray system for defining a tray surface rotatably mounted about a substantially vertical support, the system comprising:

a hub assembly rotatably mountable about the substantially vertical support and including a receptacle; and a plurality of tray segments, each tray segment defining a respective sector of the tray surface and including:

a top surface portion defining a respective sector of the tray surface;

an integrally formed clip portion depending from an inner edge of the top surface portion, the clip portion being adapted to slidably engage the receptacle of the hub to thereby secure the respective tray segment to the hub assembly; and an integrally formed perimeter wall depending from a peripheral edge of the top surface portion, the perimeter wall being adapted to cooperate with the clip portion to support the tray segment in a substantially horizontal condition when the tray segment is placed on a support surface separate from the hub assembly.

2. A tray system as claimed in claim 1, wherein the respective top surface portion of each tray segment encompasses a substantially equal circular sector of the tray surface.

3. A tray system as claimed in claim 1, wherein the respective top surface portion of each tray segment is substantially flat.

4. A tray system as claimed in claim 3, wherein the respective top surface portion of at least one tray segment comprises a plurality of mounting holes adapted to receive one or more supports defining a napkin holder.

5. A tray system as claimed in claim 1, wherein the respective top surface portion of at least one tray segment comprises an integral compartment.

6. A tray system as claimed in claim 1, further comprising a lid for at least partially enclosing the respective top surface portion of at least one tray segment.

7. A tray system as claimed in claim 6, wherein the lid is substantially transparent.

8. A tray system as claimed in claim 1, wherein the clip portion comprises a cylindrical segment-shaped wall disposed substantially perpendicular to the top surface portion of the tray segment.

9. A tray system as claimed in claim 1, wherein the hub assembly comprises:

an inner bearing member adapted to be fixedly secured to the substantially vertical support member; and an outer bearing member having a substantially cylindrical bore for slidably receiving the inner bearing member, such that the outer bearing member is freely rotatable about the inner bearing member while being simultaneously inhibited from pivoting with respect to the inner bearing member.

10. A tray system as claimed in claim 9, wherein the inner bearing member comprises a pair of opposed cylindrical section-shaped bearing portions defining an axial channel for receiving the support member.

11. A tray system as claimed in claim 10, wherein the opposed cylindrical section-shaped bearing portions are capable of clamping engagement with the substantially vertical support member.

12. A tray system as claimed in claim 11, wherein the inner bearing member further comprises at least one fastener for securing the cylindrical section-shaped bearing portions to one another and to the support member.

13. A tray system as claimed in claim 9, wherein the inner bearing member comprises:

an upper bearing surface for slidable load-bearing engagement with an end wall of the cylindrical bore of the outer bearing member; and at least one perimeter wall for slidably engaging a side wall of the cylindrical bore of the outer bearing member to prevent the outer bearing member from pivoting relative to the inner bearing member.

14. A tray system as claimed in claim 13, wherein the inner bearing member comprises at least one flange portion, a respective outer edge of each flange portion defining the at least one perimeter wall.

15. A tray system as claimed in claim 9, wherein the bore of the outer bearing member comprises:

a substantially cylindrical inner wall capable of sliding engagement with a perimeter wall of the inner bearing member to inhibit tilting movement of the outer bearing member relative to the inner bearing member; and an end wall capable of slidable load-bearing engagement with an upper bearing surface of the inner bearing member.

16. A tray system as claimed in claim 9, wherein the receptacle of the hub assembly comprises an annular groove disposed about the outer bearing member.

17. A rotatable tray system as claimed in claim 16, wherein the annular groove comprises at least one radial wall extending across the annular groove, the radial wall being operative to stiffen the receptacle and thereby inhibit pivoting of a tray segment being supported by the hub assembly.

* * * * *